United States Patent [19]

Chaires

[11] 4,245,546

[45] Jan. 20, 1981

[54] PORTABLE BULLETPROOF SHIELD

[76] Inventor: George O. Chaires, P.O. Box 5175, Tallahassee, Fla. 32301

[21] Appl. No.: 964,392

[22] Filed: Nov. 29, 1978

Related U.S. Application Data

[63] Continuation-in-part of Ser. No. 895,401, Apr. 11, 1978, abandoned.

[51] Int. Cl.[3] ..... F41H 5/08

[52] U.S. Cl. ..... 89/36 G; 109/49.5

[58] Field of Search ..... 89/36 F, 36 G; 109/9, 109/49.5

[56] References Cited

U.S. PATENT DOCUMENTS

| | | | |
|---|---|---|---|
| 660,478 | 10/1900 | Wells | 109/49.5 |
| 1,083,846 | 1/1914 | Markson | 89/36 F |
| 1,205,680 | 11/1916 | Stoneburner | 109/49.5 |
| 1,257,484 | 2/1918 | Heide . | |
| 1,261,518 | 4/1918 | Hahre . | |
| 1,267,588 | 5/1918 | Poniatowski . | |
| 1,290,606 | 1/1919 | Lovas . | |
| 1,297,904 | 3/1919 | Pietruszkiewicz . | |
| 2,316,055 | 4/1943 | Davey | 89/36 F |

FOREIGN PATENT DOCUMENTS

| | | | |
|---|---|---|---|
| 445342 | 2/1968 | Switzerland | 89/36 G |

*Primary Examiner*—Stephen C. Bentley
*Attorney, Agent, or Firm*—Dowell and Dowell

[57] ABSTRACT

A portable shield apparatus having a configuration which deflects small arms fire and constructed of a material which resists penetration thereof. The apparatus includes side and top walls and an auxiliary top member which normally is connected to a portion of the top wall but may be removed and attached to the interior surface of the side walls to serve as carrier for injured or wounded people. Also, a rear wall may be provided if desired.

5 Claims, 11 Drawing Figures

PORTABLE BULLETPROOF SHIELD

CROSS-REFERENCE TO RELATED APPLICATION

This application is a continuation-in-part of application Ser. No. 895,401 filed Apr. 11, 1978 and now abandoned.

BACKGROUND OF THE INVENTION

1. Field of the Invention

The present invention relates generally to rescue apparatus and relates specifically to a portable bulletproof apparatus which may be used to retrieve injured or wounded people who are in an exposed position and under fire.

2. Description of the Prior Art

Heretofore during wars, insurrections, riots and police actions of various kinds which involved small arms fire, people often were injured or wounded while in an exposed position and it has not been possible to rescue or retrieve these people without exposing other people to such fire who might become casualties themselves. In the distant past soldiers and other warriors carried shields for personal protection and these shields have been upgraded as disclosed in the patent to Davey U.S. Pat. No. 2,316,055, so that riot squads or other units of police departments may be equipped with shields as protection against hurled missiles such as rocks and the like. However, these shields ordinarily have not been effective against small arms fire since they have not been sufficiently strong or dense to prevent penetration of a bullet.

Some efforts have been made to provide portable shields having gun ports and the like which could be used to provide an offensive or defensive stronghold that could accommodate several people and protect such people from gunfire at least from a frontal direction. Some examples of this type of structure are the patents to Wells U.S. Pat. No. 660,478; Heide U.S. Pat. No. 1,257,484; Poniatowski U.S. Pat. No. 1,267,588; Lovas U.S. Pat. No. 1,290,606; and Pietruszkiewicz U.S. Pat. No. 1,297,904.

Additionally the patent to Hahre U.S. Pat. No. 1,261,518 discloses a movable shield having provision for a removably mounted litter which could be used for supporting injured or wounded people or could be used for various other purposes such as supporting the ammunition or rifles of the occupants.

SUMMARY OF THE INVENTION

The present invention is embodied in a portable bulletproof shield having side walls which are curved in a generally concavo-convex configuration defining a substantially wishbone shape in cross-section to deflect small arms fire from the front and from both sides. A top wall is provided which is fixed to the upper edges of the side walls for most of the length of the shield and an auxiliary top member is selectively attached to the rear of the fixed top wall so that it can be quickly and easily removed and converted into a seat or carrier for one or more injured or wounded people. In one embodiment the shield is open at the rear, and in another embodiment a door is positioned across the open rear end of the shield. The side walls of the shield are of a configuration to cause most of the bullets which strike the same to ricochet without the full impact being imparted to the shield. Normally, the shield is supported on wheels, skids or the like which support most of the weight so that one to three people can move the shield in order to rescue or retrieve a person located in an exposed position.

It is an object of the invention to provide a portable bulletproof shield which affords protection from small arms fire to one or more people when the apparatus is being used to rescue or retrieve other people from an exposed position.

Another object of the invention is to provide a portable bulletproof shield having side and top walls and an auxiliary top member which is selectively removable and may be mounted on the interior of the side walls to support at least one person.

DESCRIPTION OF THE PREFERRED EMBODIMENTS

Figure 1:
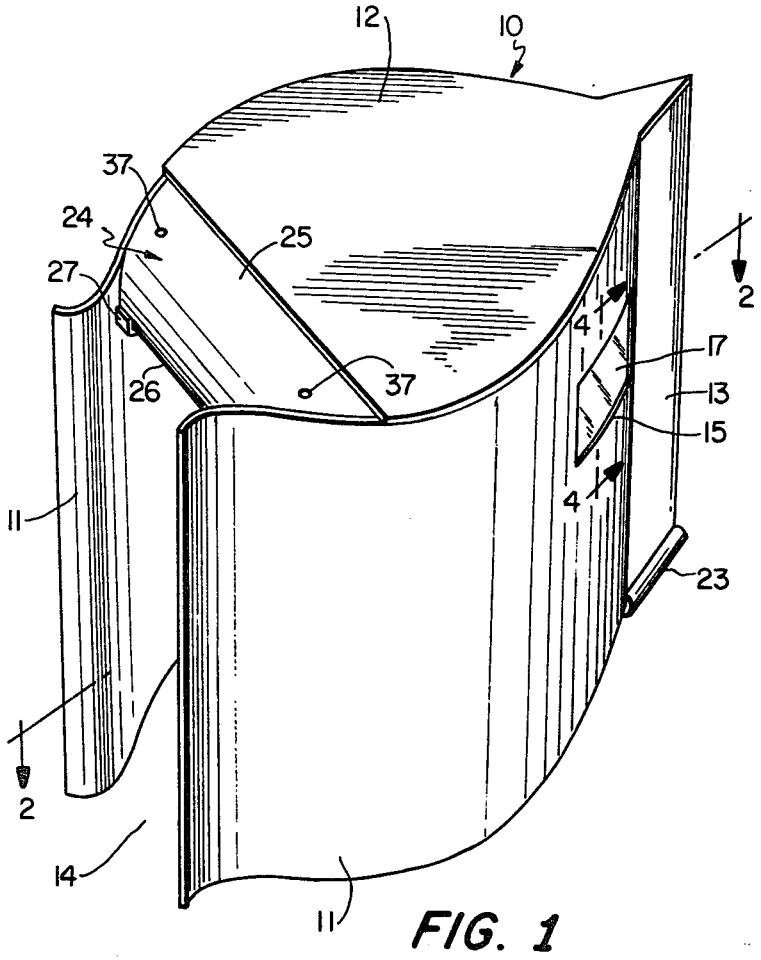
FIG. 1 is a perspective view of one embodiment of the bulletproof shield of the present invention.
Figure 4:
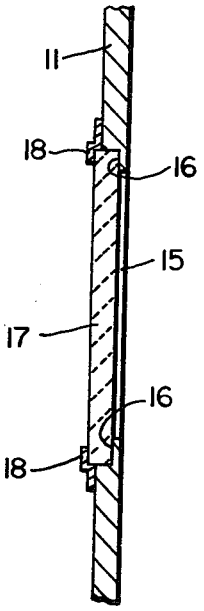
FIG. 4 is an enlarged section taken on the line 4—4 of FIG. 1.

With continued reference to FIGS. 1–7 of the drawings, the invention is embodied in a portable bulletproof shield 10 having side walls 11 and a fixed top wall 12. The side walls 11 are connected together at one end by a generally V-shaped nose or leading portion 13 which may be of thicker material than the side walls to provide a reinforcement. The side walls 11, top wall 12 and nose 13 are constructed of relatively dense material which is strong enough to resist or prevent penetration by small arms fire.

Each of the side walls 11 is generally concavo-convex in cross-section and when combined with the nose 13 such side walls define a substantially hollow wishbone configuration which has a gap or access opening 14 at the rear. Such access opening is large enough to permit easy entry of a person and large enough to permit a disabled person to be carried or dragged therethrough. It is noted that the curvature of the forward portions of the side walls adjacent to the nose is substantially a mirror image of the rearward portions adjacent to the access opening for a purpose which will be described later.

The shield 10 may be made of clear transparent material, such as bulletproof glass or thermoplastic material, or the like; however, such shield normally is made of steel or other opaque metallic material. In order to provide a viewing port when the walls are made of opaque material, each of the side walls 11 is provided with an opening 15 located adjacent to the nose 13 and such opening is provided with a peripheral recess 16 defining a shoulder for receiving a bulletproof transparent glass panel 17. The glass panel may be mounted within the recess 16 in any desired manner, as by clips or flanges 18 which are secured to the interior surfaces of the side walls and have portions which overlie the glass panel.

Figure 2:
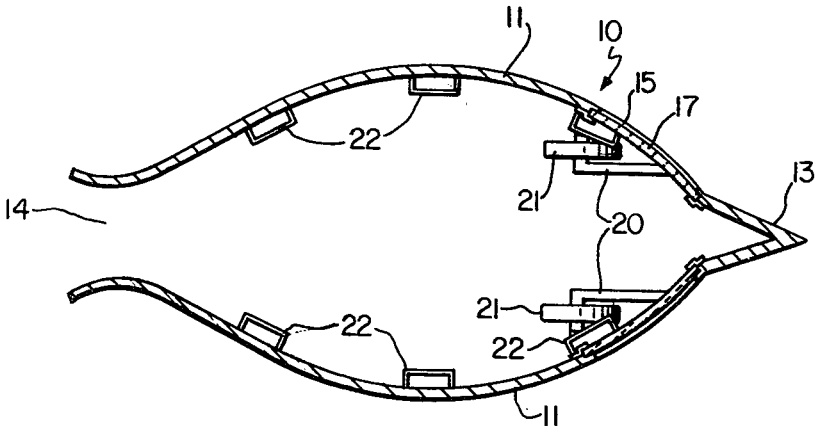
FIG. 2 is a horizontal section taken on the line 2—2 of FIG. 1.
Figure 3:
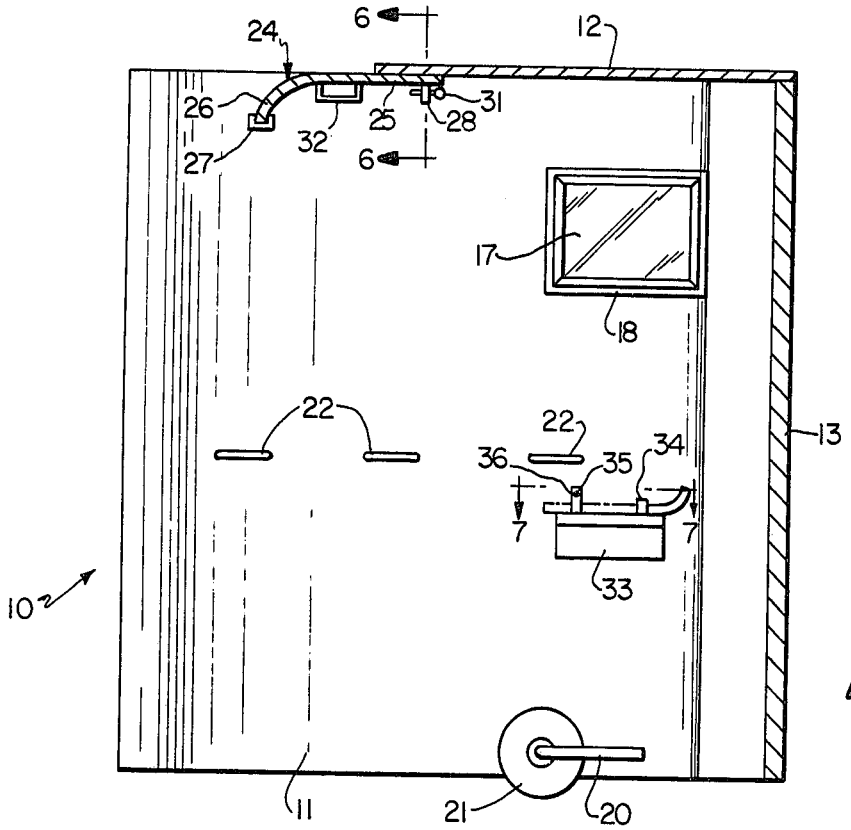
FIG. 3 is a vertical section taken longitudinally of the shield.
Figure 5:
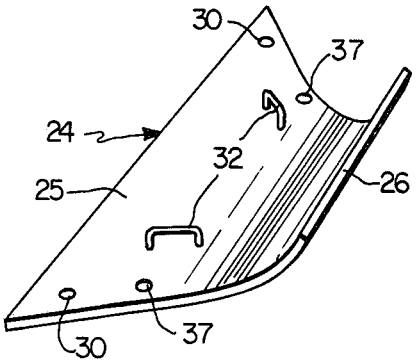
FIG. 5 is a perspective view of the auxiliary top member.
Figure 6:
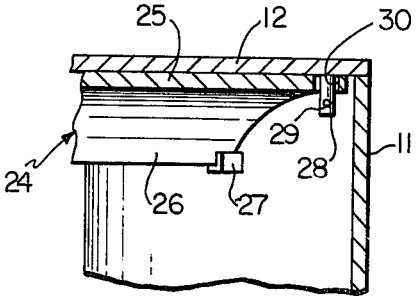
FIG. 6 is an enlarged section taken on the line 6—6 of FIG. 3.
Figure 7:
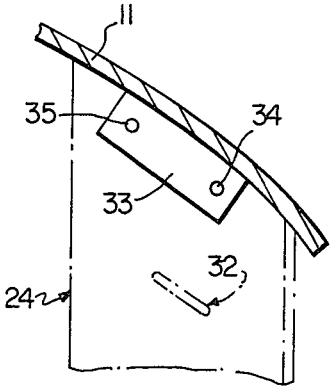
FIG. 7 is an enlarged section taken on the line 7—7 of FIG. 3.
Figure 8:
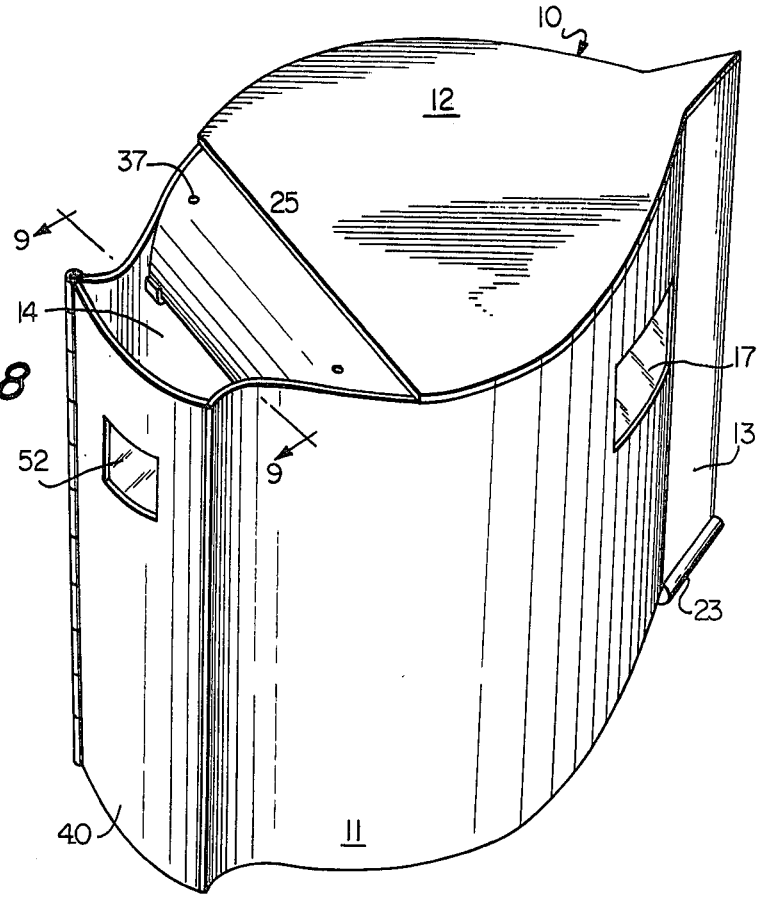
FIG. 8 is a perspective view of another embodiment of the bulletproof shield.
Figure 10:
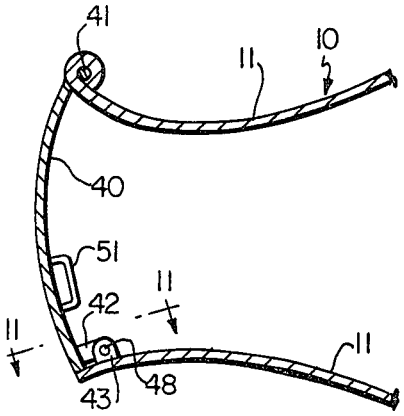
FIG. 10 is a section taken on the line 10—10 of FIG. 9.
Figure 11:
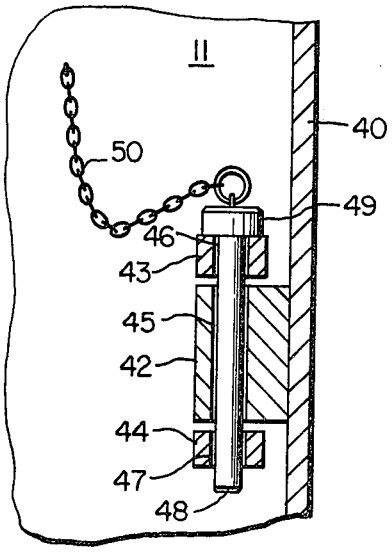
FIG. 11 is an enlarged fragmentary section taken on the line 11—11 of FIG. 10.
Figure 9:
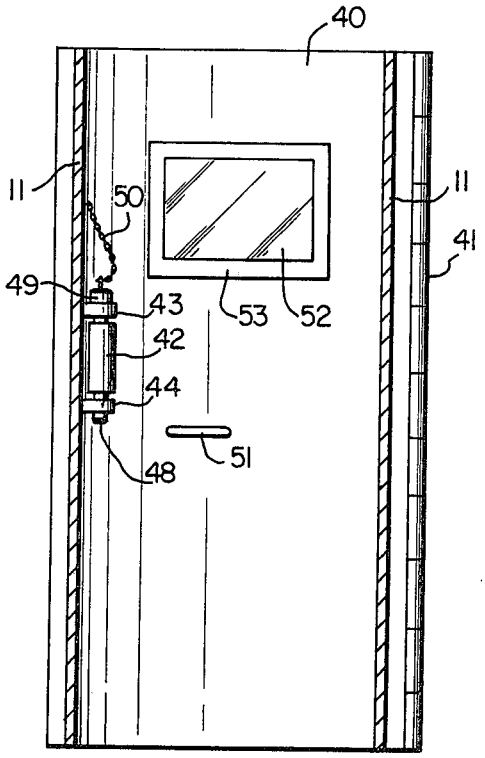
FIG. 9 is an enlarged section taken on the line 9—9 of FIG. 8.

With particular reference to FIGS. 2 and 3, the shield is provided with at least one axle 20 adjacent to the lower edge of the leading portions of the side walls and such axle supports a pair of rotatable ground-engaging wheels 21 or a roller (not shown). If desired, additional axles and wheels (not shown) may be provided at the rear of the shield so that substantially the entire weight of the shield is supported by the wheels or roller. It is contemplated that a drive motor (not shown) could be drivingly attached to the wheels 21 for moving the shield in either forward or rearward direction when desired. Also it is contemplated that when a drive motor is provided, a steering mechanism likewise will be provided so that the shield may be guided.

Additionally, it is noted that, if desired, the upper end of a downwardly extending fluid cylinder or other lifting mechanism may be swingably mounted adjacent to the front of the shield. The piston rod of the cylinder may have a foot or ground-engaging plate at the lower end so that if a relatively low obstacle such as a curb or the like is encountered, the cylinder may be operated to raise the front of the shield above such obstacle. Thereafter, the shield may be moved forwardly so that the wheels 21 are located on top of the obstacle to permit continued movement of the shield.

As illustrated in FIGS. 2 and 3, when the shield does not have a power plant, such shield may be pushed or propelled by people or operators located within the hollow shield. To facilitate movement of the shield, a plurality of pairs of handles 22 are located along the length of the side walls 11 which can be grasped by the operators who propel and guide the shield.

The lower portion of the nose 13 preferably includes a roller edge or enlargement 23 to assist in moving the shield over obstacles since the shield can slide on such enlargement. The curved configuration of the enlargement resists hanging up on any obstruction.

At the rear of the shield, a selectively movable auxiliary top member 24 is provided which preferably has a generally flat leading portion 25 and a downwardly curved trailing portion 26. It is desirable that the auxiliary top member 24 be connected to the rigid top wall 12 and the side walls 11 most of the time to afford protection for the people within the shield; however, such auxiliary top member is easily and quickly removable so that it may be converted to a seat or carrier for a person who is incapable of rapid movement. In order to do this a pair of relatively short upwardly open channel members 27 are fixed to the interior surfaces of each of the side walls 11 and extend outwardly toward each other. The upwardly disposed channel members 27 receive and support the trailing portion 26 of the auxiliary top member 24.

The leading portion 25 of the auxiliary top member is selectively connected to the fixed top wall 12 by providing the fixed top wall 12 with a downwardly extending projection 28 at each side and each of such projections has a lock pin receiving opening 29 extending therethrough adjacent to the lower end. The leading portion 25 of the auxiliary top member 24 is provided with an opening 30 at each side substantially in alignment with the projections 28 and of a size to freely receive such projections. To mount the auxiliary top member on the upper portion of the shield, after the trailing portion 26 is positioned within the channel members 27, the leading portion 25 is moved upwardly so that the projections 28 extend through the openings 30. In this position a lock pin 31 is inserted through the openings 29 generally crosswise of the projection to hold the auxiliary top member in position until the pins 31 are retracted. The auxiliary top member 24 preferably is provided with a pair of spaced handles 32 for manipulating the same. The side edges of the auxiliary top member conform generally to the configuration of contiguous portions of the side walls 11.

In order to provide a seat for a wounded or otherwise disabled person, each of the side walls 12 has a pair of angle members 33 located adjacent to the front portions thereof. Each of such angle members has one flange welded or otherwise attached to the side walls while the other flange extends into the hollow shield and is provided with a pair of upwardly extending projections 34 and 35. The projection 35 of each angle member includes a transverse opening 36 adjacent to its upper end.

When desired, the auxiliary top member 24 may be removed from its normal position in which it is connected to the fixed top wall 12 after which such auxiliary top member is inverted and placed on the angle members 33 with the openings 30 of the auxiliary top wall receiving the projections 35. The auxiliary top member has additional openings 37 for receiving the projections 34. After the auxiliary top member has been placed on the angle members, such top member may be locked therein by the pins 31 extending through the openings 36 of the projections 35. In this position an injured or otherwise disabled person may sit on the auxiliary top member and the weight of the disabled person is supported directly over the wheels 21.

It is contemplated that the wheels 21 may be removable from the axles 20 and replaced by an elongated roller for traversing sand or soft ground, or if desired the wheels may be replaced by elongated flat skids for supporting the weight of the shield over a substantial area of the ground.

With particular reference to FIGS. 8–11, the access opening 14 of the shield may be closed to afford more complete protection for the occupants, particularly when it is necessary to maneuver the shield to avoid obstacles or when the persons to be rescued are partially surrounded. In order to close the opening 14, a door 40 of relatively dense material similar to the material of the side walls 11 is connected by a hinge 41 to the rear end of one of such side walls. The door 40 may be swung about the hinge 41 to a closed position and may be locked in such position in any desired manner, such as a projection or latch 42 which is fixed to the door 40 adjacent to the edge opposite the hinge and such projection extends into the space defined by the side walls 11. The projection 42 is received between upper and lower lugs 43 and 44, respectively, which are secured to the inner surface of the side wall 11 remote from the hinge 41 and extend outwardly from such wall to a position in alignment with the projection 42. The projection 42 is provided with a vertically disposed opening or hole 45 and the upper and lower lugs 43 and 44 are provided with vertically disposed openings 46 and 47, respectively, substantially in alignment with the hole 45 when the door 40 is fully closed.

When the holes 45, 46 and 47 are in substantial alignment with each other, a locking pin 48 is inserted through such aligned holes to lock the door in closed position. Preferably the locking pin includes a head 49 at its upper end and such head is connected to one end of a cable or chain 50 the opposite end of which is welded or otherwise attached to the side wall 11 so that the pin cannot become accidentally misplaced. It is noted that the cable or chain 50 has sufficient slack to permit the pin to be entirely removed from the lugs.

In order to control the opening and closing of the door 40, a handle 51 is welded or otherwise attached to the door. After the person to be rescued has entered the shield and the door 40 has been closed and locked, the occupants of the shield move the shield in a reverse direction to a safe area to complete the rescue operation. In order to do this a viewing port or window of bulletproof transparent glass or the like 52 is provided in the door 40 and such window is mounted in any desired manner, as by clips or flanges 53 which are secured to the inner surface of the door.

In the operation of the device, when it is desired to rescue or retrieve one or more persons who are injured or trapped in an exposed position and under fire from small arms, one, two or three people may enter the hollow shield through the access opening 14 and provide motive power for the shield by grasping the handles 22 and exerting a pulling force. The forwardmost person looks through the glass panels 17 and directs the operation and direction of movement so that the shield is moved to a position between the person or persons to be rescued or retrieved and the source of small arms fire. If the person to be rescued is injured, the pins 31 are retracted and the auxiliary top member 24 is removed from the projections 28 and the channel members 27 after which such auxiliary top member is inverted and placed on the angle members 33. Thereafter the pins 31 are inserted through the openings 36 in the projections 35 to lock the auxiliary top member in position. The injured person is placed on the auxiliary top member and such injured person may use the handles 32 for stability. It is also contemplated that belts or straps (not shown) may be mounted on the shield so that the injured person may be strapped onto the auxiliary top member while it is serving as a seat. After the people to be rescued have entered the shield, the operators reverse their positions and back the shield to safety with the nose 13 facing generally the line of fire from the small arms.

I claim:

1. A portable bulletproof shield comprising a pair of side walls which are connected together at one end and are spaced apart at the other end, a top wall fixed to a portion of the upper edge of said side walls, said side walls and said top wall being constructed of material which resists penetration by small arms fire, an auxiliary top member selectively connected to said top wall, means on said side walls for selectively supporting said auxiliary top member to form a generally horizontal support when said member is removed from said top wall, each of said side walls having a concavo-convex configuration in cross-section, means for supporting said shield, and means for moving said shield, whereby people within said shield are protected from small arms fire from the front, sides and top.

2. The structure of claim 1 in which each of said side walls includes a viewing port covered by transparent bulletproof material.

3. The structure of claim 1 including a door hingedly mounted on one of said side walls in a position to close the opening between said walls at said other end, and means for locking said door in closed position.

4. The structure of claim 3 in which said door includes a viewing port covered by transparent bulletproof material.

5. A portable bulletproof shield for providing protection for one or more people against small arms fire, comprising a pair of generally vertical side walls which are connected together at one end and are spaced apart at the other end, a top wall fixed to a portion of the upper edge of each of said side walls, said side walls having a concavo-convex configuration in cross-section and defining a generally wishbone shape, said side walls and said top wall being constructed of material which resists penetration by small arms fire, an auxiliary top member, means on said side walls for supporting one end of said auxiliary top member, means on said fixed top wall for selectively connecting the other end of said auxiliary top member thereto, the edges of said auxiliary top member conforming substantially to the configuration of a portion of the rear of said side walls, means adjacent the forward portion of said side walls for selectively supporting said auxiliary top member in a position to provide a seat for a person, handle means on said auxiliary top member, means for supporting said shield in a manner to permit movement thereof, and means for moving said shield, said shield being of a size to accommodate at least one person, whereby the person within said shield is protected from small arms fire from the front, sides and top.

* * * * *